United States Patent [19]

Marshall et al.

[11] Patent Number: 4,493,619

[45] Date of Patent: Jan. 15, 1985

[54] PRESSURE SYSTEMS FOR SPRAY LIQUIDS

[75] Inventors: Barry R. Marshall, Minster Lovell; Paul A. Knight, Abingdon, both of England

[73] Assignee: Ambic Equipment Limited, Minster Lovell, England

[21] Appl. No.: 315,875

[22] Filed: Oct. 28, 1981

[30] Foreign Application Priority Data

Feb. 10, 1981 [GB] United Kingdom ..... 8103966

[51] Int. Cl.[3] ..... F04B 49/00

[52] U.S. Cl. ..... 417/307; 417/397

[58] Field of Search ..... 417/265, 299, 307, 393, 417/397, 316, 311; 137/103, 106; 91/468

[56] References Cited

U.S. PATENT DOCUMENTS

| | | | |
|---|---|---|---|
| 1,147,286 | 7/1915 | Welch | 417/307 |
| 1,501,408 | 7/1924 | Lindstrom et al. | 137/103 |
| 2,359,508 | 10/1944 | Bergstedt | 137/103 |
| 2,379,483 | 7/1945 | Hapgood | 137/103 |
| 2,434,771 | 1/1948 | Mueller et al. | 417/316 X |
| 3,147,767 | 9/1964 | Goss | 417/316 X |
| 3,194,484 | 7/1965 | Van House | 417/397 |
| 3,261,330 | 7/1966 | Arant | 417/540 |

FOREIGN PATENT DOCUMENTS

| | | | |
|---|---|---|---|
| 208816 | 2/1957 | Australia | 137/103 |
| 1002759 | 3/1952 | France | 137/103 |
| 410,067 | 5/1934 | United Kingdom | 417/395 |

*Primary Examiner*—Leonard E. Smith

*Attorney, Agent, or Firm*—Larson & Taylor

[57] ABSTRACT

A teat spray system for installation in an automatic milking parlor for spraying the teats of cows. The system comprises a differential vacuum line switch, powered from the milking parlor vacuum line, and providing alternating vacuum pulses in a pair of vacuum lines; a liquid disinfectant pressure pump powered from the pair of vacuum lines; a pressure bottle for holding a volume of disinfectant under pressure and a spray line and spray head. The system is pressure self-limiting and has a pressure release valve operative when the milking parlor vacuum line is shut down.

7 Claims, 2 Drawing Figures

PRESSURE SYSTEMS FOR SPRAY LIQUIDS

DESCRIPTION OF THE INVENTION

This invention relates to pressure systems for spray liquids which include liquid pump means powered from a vacuum source.

The invention is applicable particularly for installation in an automatic milking parlour to provide disinfectant at a pressure for spraying the teats of cows. A pressure system according to the invention may be powered from the milking parlour vacuum line and the specific embodiment later described is a system for this purpose.

Teat spray systems as such are known but in the past have been expensive to install, have involved too much additional work in use and have proved unreliable in the damp environment of milking parlours.

The object of the present invention is to provide an improved pressure system for teat spray disinfectants. The invention may be used to provide such a system which is powered automatically when the milking vacuum line pump is started, maintains a head of liquid under pressure during milking and teat spraying and, according to the preferred embodiment, de-pressurizes the system automatically after milking when the vacuum line pump is stopped.

SHORT DESCRIPTION OF THE DRAWINGS

One embodiment of the invention will now be described in detail, by way of example, with reference to the accompanying drawings, in which.

DESCRIPTION OF THE EMBODIMENT

Figure 1:
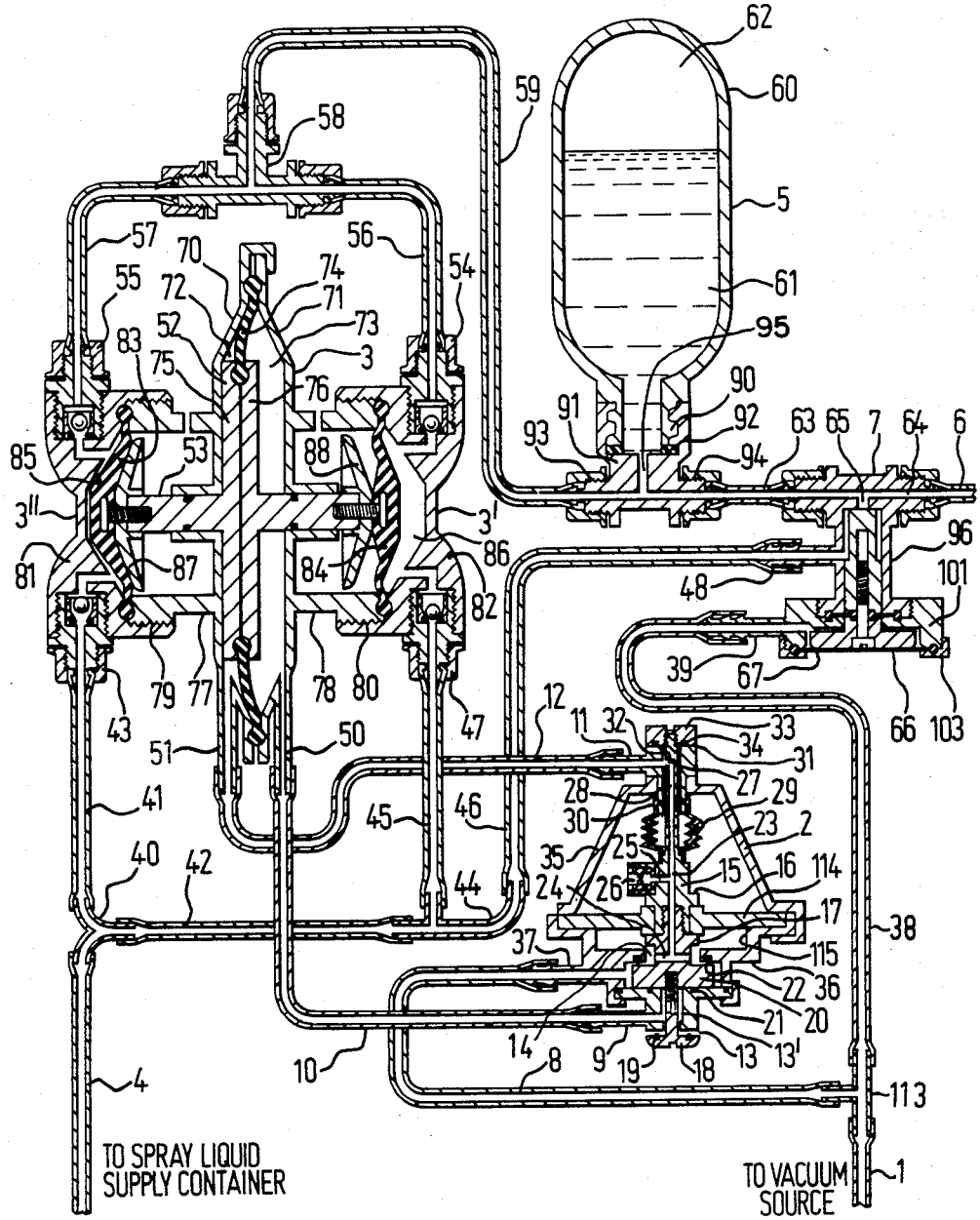
FIG. 1 is a mid-section view through all the elements of the system.
Figure 2:
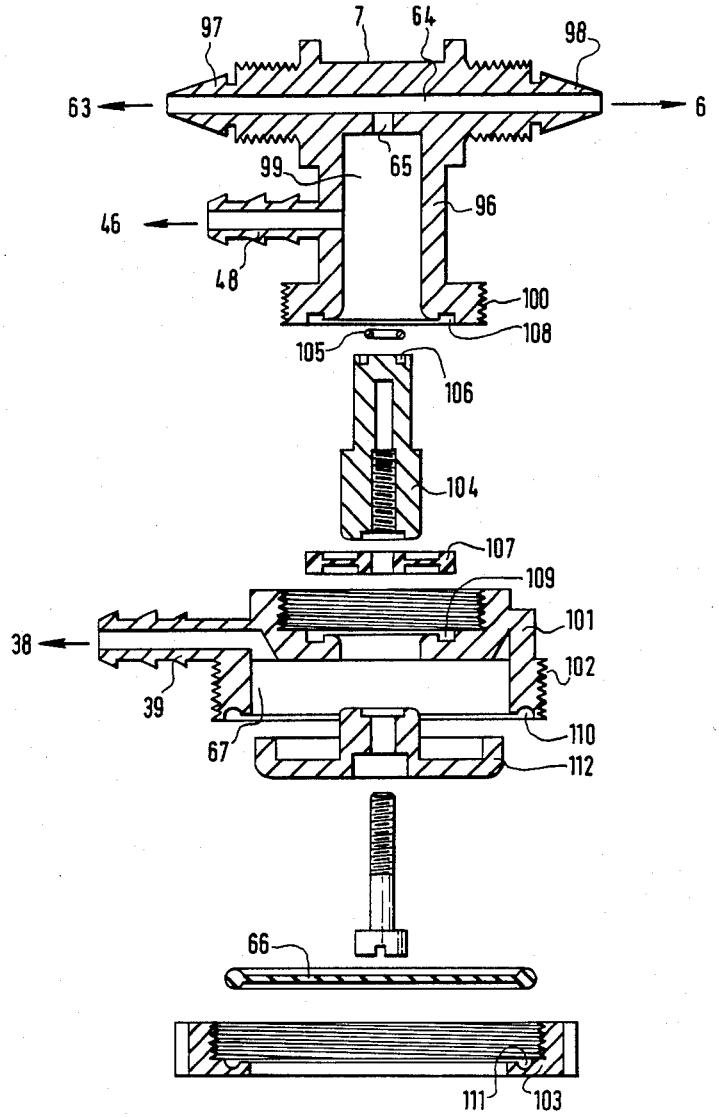
FIG. 2 is an exploded mid-section view of the pressure dump valve of FIG. 1.

As shown in FIG. 1, a pressure system for spray disinfectant liquids for cow teat spraying comprises a vacuum input line 1, a differential vacuum control valve 2, a reciprocating double liquid pressure pump 3, a disinfectant liquid suction supply line 4, a pressure disinfectant liquid reservoir 5, a pressure liquid output line 6 and a pressure dump valve 7, which is further shown in FIG. 2.

The vacuum input line 1 is supplied from a milking parlour vacuum line which supplies the milking claws. The liquid supply line 4 extends into any open container of the disinfectant liquid to be used and the pressure output line 6 extends to any suitable spray, such as a hand-held, hand-operated, liquid atomising spray.

The functions and the interconnection of the various elements of the system of FIG. 1 will be briefly described before the construction of the elements is described in detail.

The vacuum input line 1 is split at a T-connector 113 into two vacuum lines 8 and 38, of which the line 8 is connected to an input port 37 of the differential control valve 2 and the line 38 is connected to a vacuum port 39 of the dump valve 7.

The function of the differential control valve 2 is automatically to supply vacuum to two differential vacuum output lines 10 and 12, alternately supplying vacuum to line 10 while venting line 12 to atmosphere and supplying vacuum to line 12 while venting line 10 to atmosphere.

The liquid supply line 4 is split at a Y-connector 40 into liquid supply lines 41 and 42. Line 41 is connected to a liquid input port 43 of pump 3. Liquid supply line 42 is again split, at a connector 44, into a liquid supply line 45 and a liquid return line 46. Supply line 45 is connected to a second liquid input port 47 of pump 3. Liquid return line 46 is connected to a liquid output port 48 of the dump valve 7.

The differential vacuum lines 10 and 12 are connected respectively to vacuum input ports 50 and 51 of the pump 3.

The pump 3 has an internal diaphragm structure 52 to which a reciprocating shaft 53 is attached. The input vacuum ports 50 and 51 are connected to two chamber parts separated by the diaphragm structure 52 so that the differential vacuum feed displaces the diaphragm structure 52 to drive the reciprocating shaft 53. The shaft 53 in turn drives a pair of differential pump sections 3' and 3'' of the pump 3 having respectively pressure liquid output ports 54 and 55 to which are respectively connected pressure liquid output lines 56 and 57. The output lines 56 and 57 are brought together by a T-connector 58 to supply a single liquid pressure line 59 which supplies the reservoir 5.

The reservoir 5 comprises an initially air-filled pressure flask 60 which becomes partially filled by disinfectant liquid 61 to compress the air into an upper space 62. An output liquid pressure line 63 communicates both with the line 59 and with the reservoir 5 and leads, through an internal duct 64 in the body of the dump valve 7, to the pressure liquid output line 6.

The dump valve duct 64 has a branch duct 65 which communicates with the liquid output port 48. Under working conditions, branch duct 65 is kept closed. To this end, a diaphragm 66 seals an end chamber 67 to which vacuum is supplied from port 39. External atmospheric pressure acting upon the external face of diaphragm 66 keeps closed the end of branch duct 65.

When the main vacuum supply pump is stopped, after the end of a milking operation, the main vacuum supply line is vented to atmosphere in customary manner. Input line 1 then rises to atmospheric pressure so balancing the pressures on opposite faces of diaphragm 66. Dump valve 7 then opens providing connection between branch duct 65 and output port 48, so permitting the entire contents of reservoir 5 to drain through lines 46, 42 and 4 back into the disinfectant container used and thereby de-pressurizing the entire liquid system.

The differential vacuum control valve 2 will now be described in detail with reference to FIG. 1.

FIG. 1 shows a vacuum line control valve 2 comprising a hollow body formed from an upper moulded part 35, as viewed in FIG. 1, and a lower moulded part 36 assembled together with a laterally-displaceable, elastic, circular diaphragm 114 sealed between the two parts 35 and 36. The diaphragm 114 thus divides the body 35, 36 into an upper chamber and a lower chamber.

Moulded integrally with the lower body part 36 is a vacuum input port 37, which is connected to a vacuum supply line 8, and a first output vacuum port 9, which is connected to a first output line 10. Moulded integrally with the upper body part 35 is a second output vacuum port 11, which is connected to a second output line 12.

Also moulded integrally with the lower body part 36 is a passageway and valve seating structure which provides passageways between the output port 9 and a valve-controlled first vent to atmosphere at 13, a valve-controlled passageway 13' between the input port 37 and the output port 9, and a valve-controlled passageway 14 between the input port 37 and the lower chamber.

Internally of the body 35, 36 and attached at the centre of the diaphragm 114 is a reciprocating valve-closure member 15. This member is attached to the diaphragm 114 by opposed flanges 16 and 17. The member 15 is an assembly of component parts, not separately indicated in the drawings, which extends through the body 35, 36 and provides a first vent closure flange 18 carrying a ring seal 19 on its upper face. Below the passageway 14, in a small chamber directly and permanently connected to the vacuum inlet port 37, is a valve closure flange 20 which closes against a ring seal 21 on its lower face or a ring seal 22 on its upper face.

The part of the valve-closure member 15 which passes through the upper chamber is hollow to provide an internal passageway 23 which opens at its lower end into the lower chamber by way of an orifice 24. Near the middle of member 15, the passageway 23 extends into a hollow stub 25 which communicates with the upper chamber through a bleed orifice 26.

The output port 11 extends by way of an orifice 27 into a passageway 28 near the top of member 15. A bellows connector 29 seals the stem of member 15 with a stub 30 formed with the body part 35 internally of the upper chamber. Passageway 23 is thereby sealed from communication with the upper chamber except by way of the bleed orifice 26.

At the top of the control valve body part 35 is a controlled second vent to atmosphere 31 which is connected with the second port 11 by a passageway 32. At the top of member 15, externally of the control valve body part 35, the member 15 carries a second vent closure flange 33, which carries a ring seal 34.

In FIG. 1, the first vent 13 is shown open and the second vent 31 is shown closed. Correspondingly, second output port 11 is shown connected with vacuum input port 37 and first output port 9 is shown disconnected therefrom.

It will be particularly noted that the outer wall 115 of the lower chamber of body part 36 is of less diameter than the base diameter of the body part 35. Hence, when diaphragm 114 is in the position shown in FIG. 1, the area of diaphragm 114 which bounds the lower chamber is considerably less than the area of diaphragm 114 which bounds the upper chamber.

The operation of the vacuum line control valve 2 will be understood from the following description and by reference to the view of FIG. 1.

When vacuum input is first applied to the control valve 2 at port 37, and with the diaphragm 114 and valve-closure member 15 in the position shown in FIG. 1, the lower chamber is exhausted and the input vacuum is directly applied at output port 11 by way of orifice 24, passageway 23, passageway 28 and orifice 27. Output port 9 is at this time vented to atmosphere by way of open first vent 13.

The upper chamber in body part 35 will at this time be at atmospheric pressure, so that diaphragm will be drawn downwardly by the negative pressure in the lower chamber of body part 36.

Immediately, however, the pressure state in the upper chamber begins to change due to the bleed aperture 26 connecting the upper chamber at atmospheric pressure and the passageway 23 at vacuum pressure. The pressure in the upper chamber, and hence the integrated pressure over the area of the upper face of diaphragm 114, falls progressively.

During this time, the uniform pressure upwardly on the lower face of diaphragm 114 bounded by wall 115 is the vacuum pressure of the lower chamber of body part 36. In consequence of the greater area of diaphragm 114 which faces into the upper chamber of body part 35, a balance will occur between the opposed forces upon the upper and lower faces of diaphragm 114 before the pressure in the upper chamber falls to vacuum pressure.

Immediately the pressure in the upper chamber falls below this critical value, the diaphragm 114 will be displaced laterally upwardly, thereby raising the entire valve-closure structure 15 from the position shown in FIG. 1.

In this position, it will be seen that the first vent 13 is closed by movement of flange 18 closing ring seal 19. Movement of flange 20 releases ring seal 21, so opening passageway 13'. The same movement seals ring seal 22, so closing passageway 14.

At the top of the valve-closure structure 15, corresponding movement of flange 33 releases ring seal 34 to open the passageway 32.

In consequence of these valve operations, output port 9 is sealed from atmosphere and is connected to vacuum input port 37. Output port 11 is sealed from the input port 37 and is vented to atmosphere at the second vent 31.

The lower chamber of body part 36 is vented to atmosphere by way of orifice 24, passageway 23, passageway 28, and orifice 27, so that the pressure on the underside of diaphragm 114 immediately changes to atmospheric pressure.

The pressure in the upper chamber at this time will be vacuum pressure, so that the diaphragm 114 and valve structure 15 is positively held in the alternative position to that of FIG. 1.

Immediately, however, the pressure in the upper chamber begins to rise by reason of the bleed orifice 26. At this time, the lower chamber is at atmospheric pressure whereas the chamber below, which accommodates the valve flange 20 and which is connected to the vacuum input port 37, is at vacuum pressure. A differential pressure exists therefore between the upper and lower faces of the valve flange 20. Vacuum pressure is exerted upon the whole of the lower face and atmospheric pressure is exerted upon the upper face as far as the circle defined by the ring seal 22. A resultant pressure downwards therefore exists upon the whole valve closure structure 15. In consequence, before the upper chamber reaches atmospheric pressure, a resultant of pressures will cause the diaphragm 114 to return to the position shown in FIG. 1. The cycle of operation then repeats.

Instantly the valve-closure member 15 has reseated, the state of the various control valve chambers and output ports reverts to the states first described with reference to FIG. 1. The operation is repetitive so long as vacuum is applied at input port 37. The vacuum being supplied alternately to output port 9 and output port 11.

As will be evident from the foregoing description, the bleed rate causing the pressure in the upper chamber to fall from atmospheric pressure in the position shown in FIG. 1 and causing the pressure in the upper chamber to rise towards atmospheric pressure in the alternative position of valve structure 15, is determined by the diameter of the bleed orifice 24. The balance of pressures causing the diaphragm 114 to move from the alternative position to the position of FIG. 1 is determined by the effective diameter of the valve flange 20 to the ring seal 22 circle.

In the embodiment described above, these variables are set so that the interval duration of vacuum pressure and of atmospheric pressure at the output port 9 are equal to each other. Because vacuum pressure at output port 9 corresponds to atmospheric pressure at output port 11 and vice versa, equal vacuum/atmospheric pressure durations at output port 9 also defines equal vacuum/atmospheric pressure durations at output port 11.

The differential vacuum control valve 2 of this embodiment is also disclosed in copending patent application Ser. No. 311,866, filed Oct. 15, 1981.

The reciprocating double liquid pressure pump 3 will be described in detail with reference to FIG. 1. The pump casing comprises a central body portion made up from two interlocking shells 70 and 71 which together form two chamber parts 72 and 73 which are separated by the diaphragm structure 52. The diaphragm structure 52 is made up from an outer flexible annular member 74 which is sealed around its periphery to the shells 70 and 71 and is sealed around its inner edge to a pair of rigid disc members 75 and 76. The disc members 75 and 76 are constructed integrally with the two parts of the reciprocating shaft 53. Vacuum input port 51 communicates with chamber part 70 and vacuum input port 50 communicates with chamber part 71. When alternate vacuum and atmospheric pressures are applied to the pair of lines 10 and 12, by action of the differential control valve 2, vacuum is at one period applied to chamber part 72 while atmospheric pressure is applied to chamber part 73. The diaphragm structure 52 is thereby forced to the left, as seen in the view of FIG. 1. In the next following period, vacuum is applied to the chamber part 73 while atmospheric pressure is applied to the chamber part 72. The diaphragm structure 52 is thereby forced to the right, as viewed in FIG. 1. With the continuing alternating of pressures in the differential lines 10 and 12, the diaphragm structure 52 and the shaft 53 are driven in reciprocating manner from left to right.

The outer parts of the shells 70 and 71 are formed with cylindrical walls 77 and 78 having external screw threads 79 and 80 at the outer ends. These threads 79 and 80 receive the casings 81 and 82, respectively, of the twin liquid pressure pump parts 3' and 3'' of the pump 3. Screw attachment of casing 81 seals a diaphragm 83 around its periphery to form a pump chamber 85. The diaphragm 83 is carried on the left end of shaft 53 together with a backing mushroom 87, as seen in FIG. 1. Screw attachment of casing 82 similarly seals a diaphragm 84 around its periphery to form a pump chamber 86. The diaphragm 84 is carried on the right end of shaft 53 together with a backing mushroom 88, as seen in FIG. 1.

Moulded integrally with the casing members 81 and 82 are the inlet ports 43 and 47, respectively, and the outlet ports 55 and 54, respectively. Each port has an associated internal ball and seating ring type non-return valve.

It will be noted from FIG. 1 that throughout the liquid pressure portion of the system all the connections of the liquid lines, whether at pump ports, T-connections, reservoir or dump valve, are made by drawing plastics tubing of the lines over a stub pipe formed with a taper and rearward annular recess. The plastics tubing is stretched diametrally over the tapered portion and the end is received in the rearward recess. Further rearwardly of the annular recess is a threaded portion which receives an internally threaded collar having an internal complementary taper. The collar fits around the tubular line and, when screwed tightly, secures the line connection. This is a known assembly construction and need not be described in further detail.

Returning to the operation of pump 3, it will be seen that, as the shaft 53 reciprocates to and fro, the two pressure pump portions 3' and 3'' will draw liquid into the pump chambers alternately, pump liquid at pressure into the output lines 56 and 57 alternately and provide a pressure flow of liquid in the line 59 successively.

The reservoir 5 is of simple construction comprising the pressure flask 60 having a neck portion 90 with an external thread at its lower end. The neck 90 of flask 60 screws into an internally threaded carrier 91 and seats on a sealing ring 92. Line 59 attaches to an input port 93 and line 63 attaches to an output port 94. Internally of the body of carrier 91 is a duct 95 which connects the input and output ports 93 and 94 and has a branch duct leading into the pressure flask 60.

The dump valve 7 will be described in detail with reference both to FIG. 1 and FIG. 2. The dump valve 7 comprises an upper body part 96 formed with an input port 97 and an output port 98 both of the known construction described above. These ports 97 and 98 are joined by the internal duct 64 which is provided with the branch duct 65 leading into a cylindrical chamber 99 from which leads the liquid output port 48. At its lower end, the body part 96 has an external threaded portion 100 which receives an internally threaded lower body part 101. This body part also has an external threaded portion 102 which receives an internally threaded retaining collar 103. The chamber 99 houses a cylindrical plunger 104 which carries a sealing ring 105 in a circular groove 106 formed in its head. When the plunger 104 is urged upwardly, the ring 105 seals the opening from branch duct 65. When the plunger 104 is not urged upwardly, the pressure of liquid in ducts 64 and 65 moves the plunger 104 downwardly to release the pressure liquid to flow into the chamber 99 around the plunger 104 and out of the port 48 into line 46. Seepage of liquid past the lower part of plunger 104 is prevented by an annular sealing diaphragm 107 which is carried at the lower end of plunger 104 and which seats around its periphery in circular grooves 108 and 109 formed respectively in the upper and lower body parts 96 and 101. The lower body part 101 provides the end chamber 67 which is sealed by the end diaphragm 66. The diaphragm 66 is a disc seating around its periphery in grooves 110 and 111 formed respectively in the body part 101 and in the retaining collar 103. When the diaphragm 66 is urged upwardly by external atmospheric pressure acting against vacuum pressure within chamber 67, the diaphragm abuts a mushroom 112 which is attached to the lower end of plunger 104. The plunger 104 is thereby urged upwardly.

The customary milking parlour vacuum line pressure is 13 inches to 15 inches mercury. Automatically, when this vacuum pressure is applied to vacuum line 1, the differential control valve 2 operates to supply vacuum pressure and atmospheric pressure alternately and differentially on the lines 10 and 12. Pump 3 is thereby driven, by displacement of the diaphragm structure 52, to drive the liquid pressure pump elements 3' and 3''. Disinfectant liquid is drawn up line 4 from the container to provide a liquid pressure of around 40 pounds per square inch in the reservoir 5. The actual pressure may be a little above or below 40 psi according to whether the vacuum supply pressure is 13 inches or 15 inches Hg. but at whatever liquid pressure corresponds thereto the pump 3 stalls, maintaining the limiting liquid pressure but not exceeding it even if liquid under pressure is not withdrawn from line 6. When liquid is withdrawn, upon every use of the teat spray, the liquid pressure is automatically restored by pump 3, so long as the vacuum line pressure at line 1 is maintained. When the milking parlour vacuum line pump is stopped, after milking, the line 1 reverts to atmospheric pressure and the pressure in dump valve chamber 67 reverts to atmospheric pressure correspondingly. The dump valve 7 opens to dump all remaining liquid under pressure in reservoir 5 back into the disinfectant container. No liquid under pressure therefore remains to provide a hazard by, say, misuse of the spray.

In practical systems, the disinfectant liquid suction supply line 4 has an intake filter, not shown in the drawings, fitted at its intake end which dips into the disinfectant liquid in the disinfectant container. This prevents any sediment or solid particles which may collect in the disinfectant in the container from passing upwards through the pump 3 and possibly blocking the teat spray. Return of disinfectant liquid to the container by way of the dump valve 7 serves the added purpose of flushing the intake filter and returning any particles which may have collected on the filter surface back into the body of disinfectant liquid in the container.

Suitable liquid disinfectants for use in the system are iodine, chlorhexidene or sodium hypochlorite and all parts of the system with which the disinfectant liquid may come into contact are made of plastics material or synthetic rubber material which are unaffected by any of the disinfectant liquids named.

We claim:

1. A pressure system for spray liquids comprising a vacuum input line for connection to a vacuum source, a pair of intermediate differential vacuum lines, a differential vacuum line switch powered from the said input vacuum line and operative to provide alternate vacuum pulses in said pair of differential vacuum lines, a spray liquid supply line for drawing spray liquid from a supply container, a spray liquid pressure line, a spray liquid pump driven from said pair of differential vacuum lines, for drawing spray liquid under pressure into said pressure line, a spray liquid pressure reservoir supplied from said spray liquid pressure line and an output spray line from the said reservoir, including a spray liquid pressure release valve having a liquid input connected to said liquid reservoir, a liquid output for returning liquid to said spray liquid supply container and a valve control vacuum line connected to said vacuum input line, said release valve being operative to release spray liquid from said pressure reservoir into said supply container when the pressure in said vacuum input line increases towards atmospheric pressure, in which the spray liquid pressure release valve has a displaceable liquid pressure release member biassed to a position in which the release valve permits return of liquid from the pressure reservoir to said liquid supply container, a chamber sealed by a diaphragm, said diaphragm being in contact with atmosphere on one face and abutting the displaceable member on the other face, said vacuum input line being connected, by said control input line and a port, to the interior of said chamber and said displaceable member being urged to its non-release position by differential interior-vacuum and external-atmospheric pressure upon said seal diaphragm.

2. A pressure system for liquids comprising a vacuum input line for connection to a vacuum source, a pair of intermediate differential vacuum lines, a differential vacuum line switch powered from the said input vacuum line and operative to provide alternate vacuum pulses in said pair of differential vacuum lines, a spray liquid supply line for drawing spray liquid from a supply container, a spray liquid pressure line, a spray liquid pump driven from said pair of differential vacuum lines, for drawing spray liquid from said liquid supply line and suppling said liquid under pressure into said pressure line, a spray liquid pressure reservoir supplied from said spray liquid pressure line and an output spray line from the said reservoir, and including a spray liquid pressure release valve having a liquid input connected to said liquid reservoir, a liquid output for returning liquid to said spray liquid supply container and a valve control vacuum line connected to said vacuum input line, said release valve being operative to release spray liquid from said pressure reservoir into said supply container when the pressure in said vacuum input line increases towards atmospheric pressure.

3. A pressure system for spray liquids as claimed in claim 2, in which the spray liquid pressure reservoir is initially at least partially air-filled, whereby a trapped volume of air is compressed therein by liquid from said spray liquid pressure line.

4. A pressure system for spray liquids comprising a vacuum input line for connection to a vacuum source, a pair of intermediate differential vacuum lines, a differential vacuum line switch powered from the said input vacuum line and operative to provide alternate vacuum pulses in said pair of differential vacuum lines, a spray liquid supply line for drawing spray liquid from a supply container, a spray liquid pressure line, a spray liquid pump driven from said pair of differential vacuum lines, for drawing spray liquid from said liquid supply line and supplying said liquid under pressure into said pressure line, a spray liquid pressure reservoir supplied from said spray liquid pressure line and an output spray line from the said reservoir, a spray liquid pressure release valve having a liquid input connected to said liquid reservoir, a liquid output for returning liquid to said spray liquid supply container and a valve control vacuum line connected to said vacuum input line, said release valve being operative to release spray liquid from said pressure reservoir into said supply container when the pressure in said vacuum input line increases towards atmospheric pressure, and in which said differential vacuum line switch comprises a hollow body divided into two chambers by a laterally displaceable elastic diaphragm, a vacuum input port for connection to said vacuum input line, first and second differential output vacuum ports for connection to said pair of differential vacuum lines, at least one controllable vent to atmosphere, an internal communicating channel and a valve structure, said valve structure being operable by movement of said diaphragm to connect said vacuum input port alternately to the first output vacuum port, while venting the second port to atmosphere, and to the second output vacuum port, while venting the first port to atmosphere, in a continuous manner so long as a vacuum input is supplied from said vacuum source.

5. A pressure system for spray liquids as claimed in claim 4, in which the spray liquid pump is a diaphragm liquid pump driven by a differential-vacuum actuated piston.

6. A pressure system for spray liquids as claimed in claim 5, in which the said actuating piston of said spray liquid pump comprises a pair of rigid discs sealed to an outer flexible annular member, housed in a chamber and dividing said chamber into two parts, vacuum input ports connected respectively to said pair of differential vacuum lines and connecting respectively to said two chamber parts.

7. A pressure system for spray liquids as claimed in claim 6, in which the spray liquid pump is a compound diaphragm pump, having a pair of diaphragm liquid pump elements, in which the pump piston is driven in reciprocating motion from said differential vacuum lines and said pump elements are mounted for respectively providing pumping strokes with opposite strokes of said piston reciprocating motion.

* * * * *